United States Patent [19]

Rhash

[11] 4,196,574

[45] Apr. 8, 1980

[54] COMPOSITE YARN AND METHOD OF MANUFACTURE

[75] Inventor: Van G. Rhash, Asheville, N.C.

[73] Assignee: Akzona Incorporated, Asheville, N.C.

[21] Appl. No.: 903,321

[22] Filed: May 5, 1978

[51] Int. Cl.[2] ..... D02G 3/04; D02G 3/38

[52] U.S. Cl. ..... 57/226; 57/6; 57/228; 57/350; 57/908

[58] Field of Search ..... 57/140 BY, 157 F, 224, 57/206, 226, 6, 227, 228, 238, 239, 244, 245, 289, 350, 908; 28/254, 271, 274

[56] References Cited

U.S. PATENT DOCUMENTS

| | | | |
|---|---|---|---|
| 2,936,569 | 5/1960 | Mull | 57/140 BY |
| 3,116,588 | 1/1964 | Breen et al. | 57/328 X |
| 3,255,580 | 6/1966 | Garner et al. | 57/140 BY |
| 3,568,424 | 3/1970 | Marshall | 28/271 X |
| 3,678,549 | 7/1972 | Buzano | 57/157 F X |
| 3,812,668 | 5/1974 | Wilson | 57/157 F |
| 3,822,543 | 7/1974 | Edagawa et al. | 57/328 X |
| 3,831,368 | 8/1974 | Glowacki | 57/140 BY |
| 4,004,406 | 1/1977 | Suzuki et al. | 57/908 X |
| 4,051,660 | 10/1977 | Griset, Jr. | 57/140 BY |

*Primary Examiner*—Donald Watkins

*Attorney, Agent, or Firm*—Francis W. Young; Tom R. Vestal

[57] ABSTRACT

A composite yarn of a falsetwist textured continuous multifilament end and spun yarn end fluid entangled with an interyarn tangle factor of at least 20 is disclosed. The spun yarn end is wrapped around the continuous filament end in alternate and varying degrees while individual filaments of the continuous filament yarn are wrapped around the spun yarn at "locking points" along the length of the spun yarn and interlaced together. A method for manufacture of the composite yarn is also disclosed.

19 Claims, 7 Drawing Figures

COMPOSITE YARN AND METHOD OF MANUFACTURE

BACKGROUND OF THE INVENTION

Since the advent of synthetic yarns, it has been recognized that they do not have the aesthetic qualities existent in natural fibers such as cotton and wool. Although numerous attempts have been made, these natural fiber qualities such as soft texture and sheen have been difficult to duplicate in synthetics. Conversely, synthetics offer better processing and uniformity qualities than natural fibers. The characteristics which permit better hand (feel) and appearance—nonconformity of cross-section and length, to name two—make handling the natural fibers difficult.

Attempts to manufacture continuous filament synthetic yarns with natural fiber characteristics have followed numerous routes. Continuous filaments have been cut (U.S. Pat. No. 2,077,079), abraded (U.S. Pat. No. 2,255,755), and overdrawn (U.S. Pat. No. 3,137,991) to break or sever the filaments. The broken or severed filaments were to jut out from the remaining bundle to trap air for a "natural" feel to the touch.

Overfeeding one group of continuous filaments with respect to a second group and combining the two groups in a fixed relationship has been another means of attempting to duplicate the feel of natural fiber, the overfed filaments tending to flare out from the overall bundle. Various methods of combining and relatively fixing the two groups have been tried. Yarns have been plied and cabled together wherein the yarns differentially shrank when heated (U.S. Pat. No. 2,575,753). Ends of continuous filaments have been combined through falsetwisting apparatus (U.S. Pat. Nos. 3,217,482 and 3,763,640). Air or fluid entanglement has produced varying effect yarns (e.g. U.S. Pat. Nos. 3,167,847, 3,811,263, and 4,051,660).

Continuous filament synthetic yarns and natural fibers have also been combined to attempt to obtain the better characteristics of each type. U.S. Pat. No. 2,854,812 combines wool, cotton, or "man-made" fibers in a "spun" yarn with a stretchable nylon through a ringtwisting apparatus which wraps the two together. U.S. Pat. No. 2,990,673 discloses drafting and twisting fibers of a small amount of twist around a core material comprising continuous filaments with little or no twist. Similar disclosures are found in U.S. Pat. Nos. 3,153,316; 3,259,939; 3,845,611 and 3,835,638. To date, however, there has been no successful—i.e. commercially viable—blending of the better attributes of spun staple fibers and continuous filament yarns.

BRIEF DESCRIPTION OF THE PRESENT INVENTION

The present invention is directed to a combination of continuous filament synthetic yarns with a spun staple fiber yarn. By spun, it is meant the staple fibers have been parallelized along their lengths and twisted together into a cohesive bundle.

The present invention further entails the use of existing textile operation equipment for making textured yarns, although it is realized that the synthetic component may be separately textured and combined.

In operation, a synthetic, thermoplastic continuous filament polymeric yarn, such as nylon, polyester and the like, is heated to soften the yarn and falsetwisted and cooled to set the falsetwist in the yarn. A second yarn, which is a spun yarn is fed in conjunction with the textured yarn after the falsetwist zone and the two yarns are passed through a fluid jet device and entangled along their lengths to form a cohesive strand structure. The spun yarn may be of numerous materials including cotton, wool, rayon, polyester, silk, nylon, acrylics, asbestos, glass or blends of polyester and cotton or polyester and wool. The range of spun yarn counts for textile applications is preferably from 15/1 to 60/1. The preferred denier range for the synthetic textile yarn is from 110 denier to 340 denier. The number of filaments of textured yarn is preferably above 30, and the denier per filament is preferably below 5.

The resultant composite yarn or thread has greater bulk characteristics and performs well through later yarn and fabric processing. The process disclosed also permits more flexible engineering of yarns and fabrics for desired end uses.

DETAILED DESCRIPTION OF THE DRAWINGS

Figure 1:
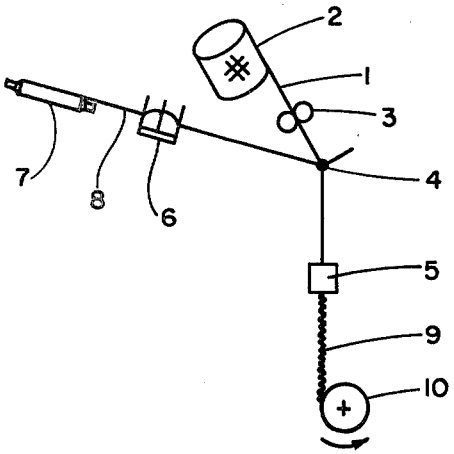
FIG. 1 is a schematic representation of a sequential process of the invention where the polyester yarn has been separately textured.

A textured continuous filament synthetic polymeric yarn 1 from a supply package 2 is forwarded by rollers 3 through a guide 4 to a fluid tangling device 5. A spun yarn 6 of discontinuous staple fibers is removed from a supply source 7 and passed through a tension device 8 and guide 4 into alignment with the continuous filament textured yarn 1.

The two yarns 1 and 6 are subjected to fluid action from a fluid supply source not shown while being passed through the fluid tangling device 5. While such devices are known, the device particularly disclosed in U.S. Pat. No. 3,823,449 has been found to constitute the preferred characteristics to the final yarn product. The amount (velocity, pressure, type, etc.) of fluid will vary from differing device to device and can be determined by those skilled in the art.

It is preferable that the spun yarn 6 contain sufficient twist to prevent undue loss of fibers during handling of the yarns through the fluid tangling device 6. Frequent entrainment of the spun yarn 6 in the continuous filament yarn 1 after tangling will aid protecting the fibers from abrasion.

The resultant combined yarn 9 is then wound into a package 10, which may be of any conventional type, although a flat package take-up is schematically shown.

Figure 2:
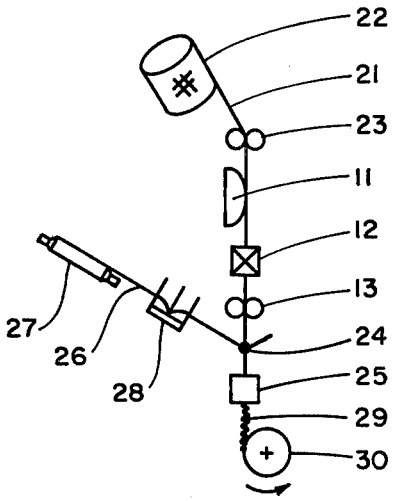
FIG. 2 schematically represents the embodiment of a simultaneous continuous filament yarn texturing zone in line with the step of combining the spun yarn.

In FIG. 2, a package 22 of flat or non-textured yarn 21 is fed through guide rollers 23 and over a heater element 11 to a falsetwist device 12, imparting a texture to the yarn as it cools. The now-textured yarn is forwarded by rollers 13 to a guide device 24 where the yarn is combined with a spun yarn 26. The spun yarn 26 is obtained from package 27 and is passed through a tension guide 28 to maintain a minimum tension as the spun yarn is entangled with the textured yarn 21 in the fluid tangling device 25.

The yarn 21 is considered a "lively" yarn, or full torque yarn, after passing through the falsetwist texturing zone and has a tendency to contract and twist due to the "live" torque in the yarn. Further, it is preferred that there be negligible tension on the yarn while it passes through the interlace device. The yarn length also has a tendency to contract as its filaments wrap frequently around the spun yarn 26. The velocity at which the textured yarn 21 is fed to the fluid tangling device 25 is therefore preferably greater than the winding velocity of the combined yarn 29 with package 30.

Figure 3:
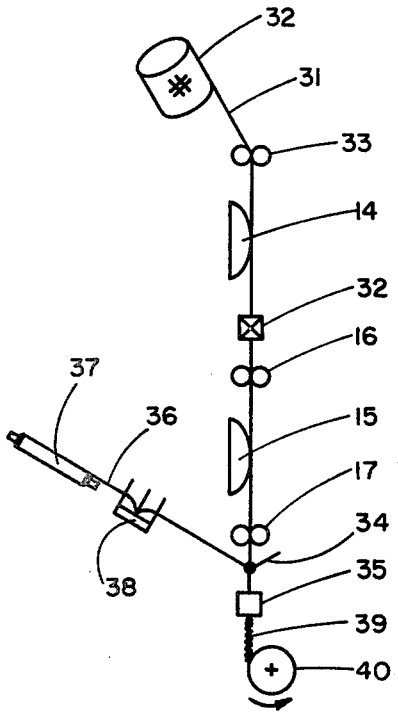
FIG. 3 schematically represents the present invention embodied with an existing falsetwist texturing machine.

A typical "double heater" falsetwisting machine is depicted in FIG. 3 wherein the yarn processing path is over two heating elements 14 and 15 with a falsetwisting device 32 and associated process control rollers 33, 16 and 17. The machine is modified by the addition of a tension device 38 for a spun yarn, an eyelet guide 34 and fluid tangling device 35.

A feeder yarn 31—undrawn, partially drawn, or fully drawn—from package 32 is fed through rollers 33 to a falsetwist texturing zone defined between rollers 33 and 16. In the instance of fully drawn yarns, the relative surface speed of rollers 16 is slightly less than rollers 33 to compensate for twist insertion into the yarn 31 by falsetwist device 32 and contraction of the yarn because of heat transmitted to it by heating element 14. For yarns that have their crystalline and amorphous structure virtually unoriented or partially oriented, the surface velocity of rollers 16 will be greater relative to rollers 33 in accordance with the amount of stretch necessary for orientation of the structure.

In operation of the device of FIG. 3, a yarn 31 from a supply package 32 mounted in a known creel (not shown) is passed first to a heating element 14, falsetwist texturing element 32, then rollers 16 in the normal manner of operation of the machine. The textured yarn 31 is then passed over a second heating element 15 under conditions where the relative surface velocity of rollers 17 is less than that of rollers 16, thereby stabilizing the tendency of the yarn to twist due to the induced torque of the texturing step.

The now "set" yarn 31 is passed through guide element 34 and combined with a spun yarn 36 from a supply package 37. The tension of the spun yarn is, as before, controlled by a tension device 38 of any known means for setting a slight tension. The combined yarns 31 and 36 are then passed through the fluid tangling device where filaments of yarn 31 wrap and intermingle about the spun yarn 36. Preferably, the winding velocity is lower than the surface velocity of rollers 17, for reasons mentioned above.

Figure 4:
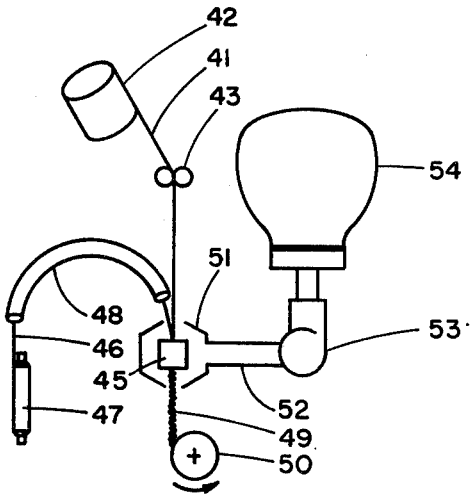
FIG. 4 depicts an embodiment having lint control devices incorporated therein.

In order to overcome linting problems caused by dislodging or other breaking away of small fibers from the spun yarn core, it is desirable to enclose the spun yarn to the extent possible. Such enclosures are shown in the embodiment of FIG. 4. A feed yarn 41 from a supply package 42 is fed by rollers 43 to a fluid tangling device 45. The yarn 41 may be textured by known means prior to being formed into package 42. A spun yarn 46 from a supply package 47 is fed via a conduit 48 and combined with the feed yarn 41. The conduit should be of abrasion resistant material but may be flexible or rigid. Examples of operable materials include nylon and stainless steel, but other materials may be selected, depending on the particular usage. An enclosure device 51 surrounds the fluid tangling device 45 and is connected through duct 52 to a fan or other air withdrawal means 52 for evacuating the space around the tangling device 45. The exhaust of the air withdrawal means 53 is directed to a filter device 54 where lint collected in the process is trapped.

The smooth bore conduit 48 may be formed to also act as a tension device solely or in conjunction with a tension device shown in FIGS. 1–3. In operation, the spun yarn will be pulled through the conduit 48 by a suction means not shown and threaded through the fluid tangling device. It is preferable to have the exit end of the conduit 48 proximate the enclosure 51 so that loose fibrous particles passing through the conduit will be trapped by the suction of the air withdrawal means and captured in the filter device 54.

Figure 5:
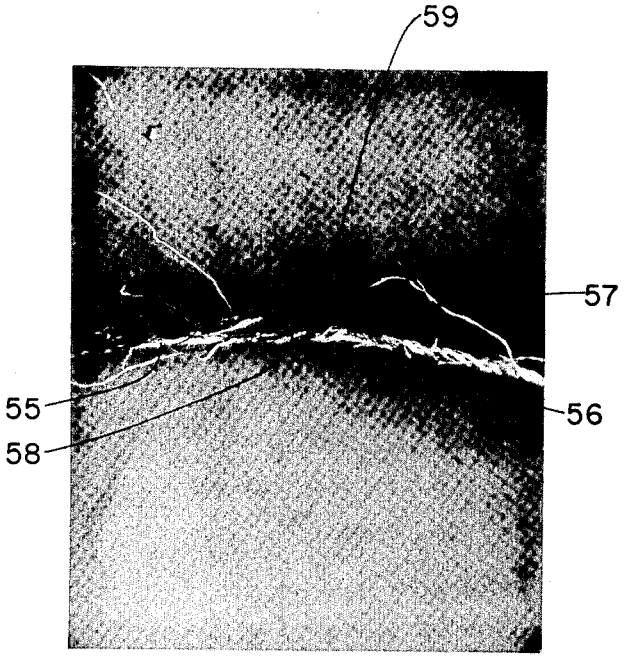
FIGS. 5 and 6 show the combined yarn on a microscopic scale.

The combined yarn 55 is depicted in FIG. 5 on a microscopic scale, wherein the spun yarn 56 is randomly wrapped in alternating and varying degrees about the textured continuous filament yarn 57. Along the lengths of the yarns the filaments 58 of the textured continuous filament yarn 57 are wrapped about the spun yarn 56 at various locking points 59.

Figure 6:
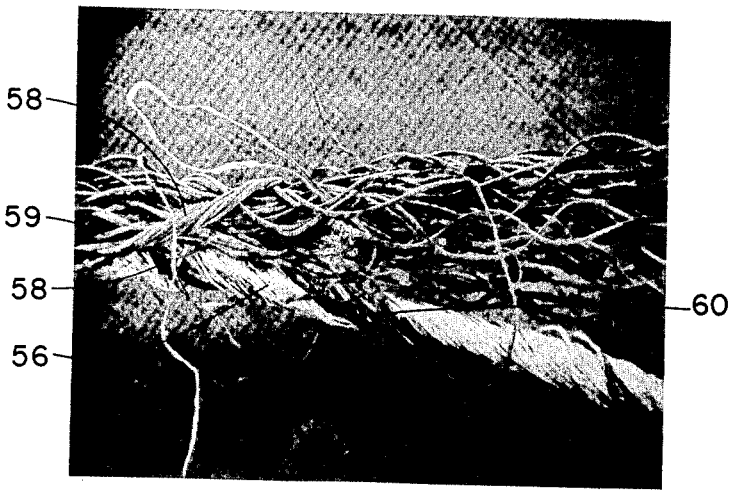

At these locking points 59, it can be seen from FIG. 6 on a microscopic scale that the individual filaments 58 separate and wrap around the spun yarn 56 and interlace with adjacent filaments to "lock" the spun yarn 56 and continuous filament yarn 57 together.

Additionally, any filaments 60 of the continuous filament yarn 57 that may be broken during texturing will wrap tightly about the spun yarn 56. The distance D between locking points corresponds on the average to as $\lambda$ defined in Example II hereinafter.

The average distance between locking points 59 and the varying twist of the spun yarn about the continuous filament yarn determines the heather effect of the yarn in fabric form caused by differing dyeabilities of the spun and continuous filament yarns. The greater the distance between locking points, the longer the striations forming the heather effect are in the fabric.

The several advantages of the present entangled spun yarn/textured continuous filament yarn over existing yarns include the strength retention of the continuous filament yarns while retaining the aesthetics of the spun yarn. The combined yarn of the present invention has more effective volume than ply-twisted combination yarns as well as better flex capability or drapability. In addition, the random intertwining of the continuous filaments around the spun yarn masks the sometimes poor resistance to abrasion of the spun yarn.

Additionally, the combined yarns of the present invention resist strip back in processing in case of breakage of one of the yarns. This resistance to strip is due to the frequent intertwining of the filaments of the continuous filament yarn about the spun yarn.

The yarn of the present invention exhibits greater covering power than twist plied yarns since the textured filaments are overfed through the fluid tangling jet. Since twist plying tends to compact the bulk, the covering power of the present yarn is greater because the continuous filaments are not smoothly wrapped around the spun yarn as in twist plied yarns.

Twist plied yarns tend to have repeating or patterning effect in fabrics, due in large part to the almost precise periodicity of twisting of the yarns together. This patterning effect is undesirable in many fabric constructions and is avoided by the random twisting structure of the textured filaments about the spun yarn, creating a random striated effect in fabrics where the continuous filament and spun yarns are differently dyed. The random striations exhibit a natural heather look in the fabric, and can be varied by controlling the level of tangles in the combined yarn. Of course, union dye effects can be obtained if the heather effect is not desired.

The present yarn has better abrasion qualities than twist plied yarns in that the intertwined synthetic filaments tend to shield the staple fibers of the spun yarn from abrasion. In twist plied yarns the continuous filaments have a tendency to shear the spun yarns because of the higher tension levels and periodic wrapping of the continuous filaments about the spun yarn.

It is preferable to balance the torque of the textured yarn as the balancing aids in further processing of the combined yarn. It also reduces the tendency of circular knitted fabrics, for example, to be skewed. Balancing may be accomplished by combining similar twist type spun and textured yarns—e.g. "Z" twisted spun yarns with "Z" twist textured continuous filament yarns. The "Z" twist-textured continuous filament yarn exhibits a torqueing tendency in the opposite direction and is counteracted by the "Z" twisted spun yarn. Conversely, an "S" twist textured continuous filament yarn exhibits a "Z" torquing tendency and may be counteracted by an "S" twisted spun yarn.

The amount of twist in the spun yarn is not to be necessarily high, but sufficient to process through the steps outlined in the figures above. Balancing of the torque of the combined yarns will produce a yarn such that, when a sample length of about 30 inches long is folded in half and held at one end with the other end freely hanging, the yarn will show little tendency to twist about itself.

EXAMPLE I

A series of combined yarns processed according to FIG. 2 were made utilizing rayon staple fibers of 1-½ denier ×1-9/16" length twisted together in the "Z" direction and polyester (PET) continuous filaments of the denier shown in Table 1. Table 1 shows the size of rayon spun yarn in terms of cotton count, air pressure used in the fluid tangling device and twist level and overfeed of the polyester (PET) into the fluid tangling device. Each yarn was woven into a fabric and selectively dyed to exhibit a cross dye effect. All fabrics had a pleasant spun yarn effect and desirable hand.

TABLE 1

| Sample | PET Denier & Filament Count | Rayon Count | Ratio PET/Rayon | Total Denier | Air Pressure (PSIG) | Twist Level of PET (TPI) | PET Overfeed % |
|---|---|---|---|---|---|---|---|
| 1 | 170/64 | 50/1 | 60/40 | 275 | 30 | 62 | 8 |
| 2 | 2 × 110/64 | 50/1 | 70/30 | 325 | 30 | 55 | 8 |
| 3 | 2 × 170/32 | 50/1 | 80/20 | 450 | 30 | 49 | 8 |
| 4 | 170/64 | 36/1 | 50/50 | 320 | 30 | 62 | 6 |
| 5 | 2 × 110/64 | 36/1 | 60/40 | 370 | 30 | 55 | 6 |
| 6 | 2 × 170/32 | 36/1 | 70/30 | 490 | 30 | 49 | 6 |
| 7 | 170/32 | 36/1 | 50/50 | 320 | 30 | 62 | 6 |
| 8 | 2 × 170/32 | 15/1 | 50/50 | 690 | 40 | 49 | 6 |

EXAMPLE II

Seven-hundred fifty (750) packages of combined 220 denier 48 filament continuous length polyester yarn and 40/1 (cotten count) single rayon yarn were prepared for a warping, slashing and weaving evaluation. The rayon yarn was made from 1-½ deniers ×1-9/16" staple length rayon twsited together 22-½ turns per inch in a "Z" twist. The polyester yarn was falsetwist textured to a level of 55 turns per inch and overfed 8% into the fluid tangling zone. A minimum tension was maintained in the rayon yarn to preserve tautness.

The cohesion between the spun yarn and continuous filament yarn, or interyarn cohesion, was measured by fixing a sample of yarn at one end and placing a ½ gram tension on the other end. A needle probe was placed in the combined yarn in a loop area between the spun and continuous filament yarns and moved toward the fixed end until meeting resistance. A hook having a 2-½ gram suspended weight attached was then inserted adjacent to the needle probe and permitted to move away from the needle probe until coming to a stop. The distance between the needle probe and hook in centimeters was measured and recorded.

This procedure was repeated 25 times at random distances along the combined yarn sample and the measured distances were averaged to achieve an average distance between successive yarn tangles.

The interyarn tangle factor (IYTF) was then calculated by dividing the average tangle distance $\lambda$ into 100 or $IYTF = 100/\lambda$.

Representative examples of variation of texture level, fluid pressure and tension of the spun yarn are shown in Table 2.

TABLE 2

| Texture TPI | Fluid Pressure | Spun Yarn Tension-Grams | Textured Yarn Overfeed | IYTF |
|---|---|---|---|---|
| 74 | 50 | 4–6 | 8 | 89 |
| 74 | 30 | 2–4 | 8 | 73 |
| 69 | 50 | 3–7 | 8 | 88 |
| 69 | 30 | 3–5 | 8 | 79 |

EXAMPLE III

Two combined yarns were made similar to Example II except the combined yarns were made utilizing 110 denier, 64 filament textured polyester yarn in one and 110 denier, 32 filament textured polyester yarn in the second. The IYTF value for the 110/64 sample was determined to be 77, while the IYTF measurement for the 110/32 sample was determined to be 30. This indicates that fineness of filament deniers play an important part of making combined yarns with high IYTF values.

EXAMPLE IV

A comparison of the effect of steel tubing and plastic tubing as shown in FIG. 4, reference numeral 48 was conducted on a Barmag FK-5 draw falsetwist texturing machine. Polyester continuous filament yarn of 110 total denier and 64 filaments was textured in the conventional manner and combined with an "Z" twisted 50/1 spun cotton yarn as shown in the embodiment shown in FIG. 2.

The polyester yarn was textured at a level of 74.4 TPI in the "Z" direction and overfed 8% into the fluid tangling zone. The tension on the spun yarn going into the tangling zone was maintained at 5 grams. The results of the experiment are shown in Table 3.

TABLE 3

| Yarn No. | Tube Type | Fluid Pressure (PSIG) | IYTF |
|---|---|---|---|
| 1 | Nylon 1/4" I.D. | 30 | 69 |
| 2 | Stainless 5/16" I.D. | 30 | 77 |
| 3 | Nylon 1/4" I.D. | 40 | 86 |
| 4 | Stainless 5/16" I.D. | 40 | 87 |
| 5 | Nylon 1/4" I.D. | 50 | 91 |
| 6 | Stainless 5/16" I.D. | 50 | 92 |

EXAMPLE V

The yarns of Example II were woven into a 56×60 fabric construction having a weight of 5.7 oz./yd.$^2$ and piece dyed a dark grey. The yarns were placed in both the warp and filling. The resultant fabric was subjected to a series of tests and compared to accepted standards for this fabric construction in men's outerwear. The results of the test and comparison are set forth in Table 4 and Table 5.

EXAMPLE VI

Figure 7:
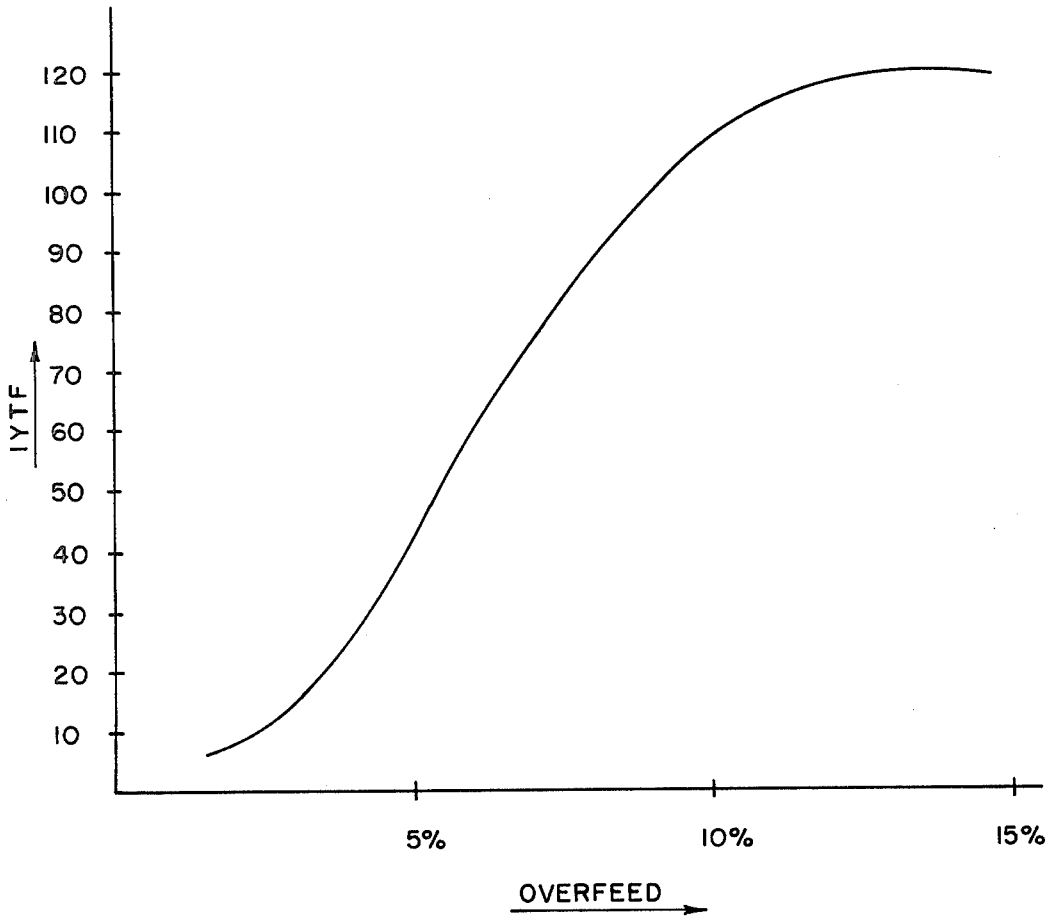
FIG. 7 shows the relationship between IYTF and overfeed for the yarn of example VI.

Combined yarn of "Z" twisted 50/1 spun cotton yarn and "Z" twist-textured polyester yarn of 110 denier, 64 filaments was made by passing the yarns through a fluid tangling device having an air pressure entering device of 30 psig. The spun yarn had a tension of 5 grams into the fluid tangling device. The overfeed of the textured polyester yarn was varied and IYTF measurements were made on the combined yarns. The results are shown in the graph of FIG. 7. Percent overfeed of the textured yarn was calculated according to the equation $$\frac{\text{feed speed} - \text{take-up speed}}{\text{feed speed}} \times 100$$

What is claimed is:

1. A combination yarn consisting of a falsetwist textured polyester continuous multifilament yarn and a spun yarn selected from the groups of cotton, wool, rayon, polyester, silk, nylon, acrylics, asbestos, glass and blends of polyester and cotton and polyester and wool; the spun yarn being randomly wrapped around the continuous filament yarn in varying degrees along its length, and filaments of the continuous filament yarn being separated and wrapped around the spun yarn and then interlaced to form locking points along the combination yarn length, the combination yarn having an interyarn tangle factor IYTF of at least 20.

2. The combination yarn of claim 1, wherein the falsetwist textured polyester continuous multifilament yarn contains at least 30 filaments.

3. The combination yarn of claim 1 or 2, wherein the continuous filament yarn is twist-textured in the "Z" direction and the spun yarn is twisted in the "Z" direction.

4. The combination of yarn of claim 1 or 2, wherein the continuous filament yarn is twist-textured in the "S" direction and the spun yarn is twisted in the "S" direction.

5. The combination yarn of claim 1, wherein the percent of continuous filament yarn is between about 50% to 80% and the percent of spun yarn is between about 20% to 50%.

6. The combination yarn of claims 1 or 2 having at least two ends of falsetwist textured continuous multifilament polyester yarn.

7. The combination yarn of claim 1, including one end of falsetwist textured continuous multifilament polyester yarn and a continuous multifilament yarn of different dyeability.

8. The combination yarn of claim 7 having one end of falsetwist textured continuous multifilament polyester yarn and one end of falsetwist textured continuous filament nylon yarn.

9. The combination yarn of claim 1 wherein the polyester falsetwist textured continuous filament yarn has a total denier of less than 220 and a filament count at least 48.

10. The combination yarn of claim 9, wherein the average denier per filament of the polyester falsetwist textured continuous filament yarn is less than 2.

11. A combination yarn having enhanced drapability comprising a spun yarn and a falsetwist textured continuous filament synthetic polymeric yarn fluid entangled along their lengths and having a value of IYTF of at least 20, that spun yarn being randomly wrapped around the continuous filament yarn to varying degrees and in alternating directions.

12. The combination yarn of claim 11 wherein the twist of the spun yarn is in the same direction as the twist-texture of the continuous filament yarn.

13. The combination yarn of claim 11 or 12 wherein the average denier per filament of the continuous filament yarn is less than about 2 and the total number of filaments exceeds about 20.

14. The combination yarn of claim 13 wherein the cotton count of the spun yarn is between 50/1 and 15/1, the total denier of the continuous filament yarn is between about 110 and 340, the ratio of continuous filament yarn to spun yarn is from about 50/50 to 80/20 and the total denier of the combination yarn is from about 275 to 690.

15. A combination yarn having enhanced abrasion resistance comprising one yarn end of falsetwist textured continuous filament polyester yarn having an average denier per filament of less than about 5 and a spun yarn end selected from the group of cotton, wool, rayon, polyester, silk, nylon, acrylic, modacrylic, asbestos, glass, blends of two or more of the above, the ratio of continuous filament yarn to spun yarn being from about 50/50 to 80/20 and the combination yarn having an IYTF value of at least 20.

16. A combination yarn having increased covering power in fabric form and process stripping resistance comprising one end of falsetwist textured polyester continuous multifilament yarn and one end of spun yarn, the average denier per filament of the continuous filament yarn being less than about 5, the cotton count of the spun yarn being finer than about 15/1, a total denier of between about 275 to 690, a continuous filament/spun yarn ratio of about 50/50 to 80/20 and the combined yarn having an IYTF value of at least 20.

17. A method of forming a combination yarn of polyester and a material selected from the group of cotton, wool, rayon, polyester, silk, nylon, acrylic, asbestos, glass and blends of polyester and cotton and polyester and wool, and having improved drapability and covering power, comprising the steps of forming a spun yarn having a cotton count finer than 15/1, falsetwist texturing continuous filament polyester yarn of at least about 30 filaments and average denier per filament of less than about 5 and total denier of about 110 to 340, simultaneously feeding the textured continuous filament yarn and spun yarn to a fluid tangling zone and interlacing the continuous filament and spun yarns along their lengths to a IYTF value of at least 20 while twisting the spun yarn around the continuous filament yarn in alternating directions of varying amounts and thereafter winding the combined yarn into a package at a speed of 3% to 15% less than said feeding speed.

18. The method of forming the combination yarn of claim 17 comprising spinning and falsetwist texturing the spun yarn and continuous filament yarn, respectively, in the same direction, and thereafter forwarding the spun yarn to the fluid interlacing zone under a tension of 3 to 8 grams continuous filament yarn to the interlacing zone at a speed greater than the combined yarns winding speed.

19. A method of manufacturing a combination yarn comprising a falsetwist-textured continuous multifilament polyester yarn and a spun yarn selected from the group consisting of cotton, wool, rayon, polyester, silk, nylon, acrylic, asbestos, glass and blends of polyester and cotton and polyester and wool, comprising the steps of feeding the spun yarn to a fluid tangling zone under a tension of 3 to 8 grams at a determined speed; feeding the continuous multifilament polyester yarn to the fluid tangling zone at a second determined speed; twisting the spun yarn about the continuous filament yarn in the fluid tangling zone in random, alternating directions in varying degrees and interlacing the filaments of the continuous yarn at intervals about the spun yarn to form an IYTF value of at least 20; withdrawing the spun and continuous filament yarns from the fluid tangling zone at a rate 3% to 15% less than said second determined speed; and thereafter winding the yarns into a package.

* * * * *